US010395668B2

(12) United States Patent
Ramo

(10) Patent No.: US 10,395,668 B2
(45) Date of Patent: Aug. 27, 2019

(54) SYSTEM AND A METHOD FOR DETERMINING AN INTERFERENCE OR DISTRACTION

(71) Applicant: Bang & Olufsen A/S, Struer (DK)

(72) Inventor: Jussi Ramo, Espoo (FI)

(73) Assignee: BANG & OLUFSEN A/S, Struer (DK)

( * ) Notice: Subject to any disclaimer, the term of this patent is extended or adjusted under 35 U.S.C. 154(b) by 0 days.

(21) Appl. No.: 15/939,094

(22) Filed: Mar. 28, 2018

(65) Prior Publication Data

US 2018/0286427 A1 Oct. 4, 2018

(30) Foreign Application Priority Data

Mar. 29, 2017 (DK) ..... 2017 00219

(51) Int. Cl.
*G10L 25/51* (2013.01)

(52) U.S. Cl.
CPC ..... *G10L 25/51* (2013.01)

(58) Field of Classification Search
CPC .. G10L 25/51; G10K 11/175; H04K 2203/12; H04S 2400/09
USPC ..... 381/56
See application file for complete search history.

(56) References Cited

U.S. PATENT DOCUMENTS 5,131,048 A 7/1992 Farenelli et al.
5,862,230 A * 1/1999 Darby ..... H04S 1/00 381/56
8,274,546 B1 9/2012 Nicolet et al.
2004/0021351 A1 2/2004 House
2008/0130922 A1* 6/2008 Shibata ..... H04S 1/002 381/302
2008/0130924 A1 6/2008 Vaudrey et al.
2010/0158263 A1* 6/2010 Katzer ..... G10K 11/175 381/73.1
2010/0291965 A1* 11/2010 Tabe ..... H04M 1/6083 455/550.1
2010/0299144 A1* 11/2010 Barzelay ..... G10H 1/0008 704/233
2012/0020486 A1 1/2012 Fried et al.
2012/0032876 A1* 2/2012 Tabe ..... H04B 1/3838 345/156
2012/0034954 A1* 2/2012 Tabe ..... H04M 1/0202 455/566

(Continued)

FOREIGN PATENT DOCUMENTS

EP 1538868 A2 6/2005
WO WO-2008/111023 A2 9/2008
WO WO-2012/003894 A1 1/2012

OTHER PUBLICATIONS

"Algorithms to measure audio programme loudness and true-peak audio level." Recommendation ITU-R BS.1770-4 (Oct. 2015).

(Continued)

*Primary Examiner* — Yogeshkumar Patel
(74) *Attorney, Agent, or Firm* — Harness, Dickey & Pierce, P.L.C.

(57) ABSTRACT

A method and a system for determining an interference value. The method receives a sound signal and an interferer signal and forms a pair of a portion of the sound signal and the interferer signal. The portions have a predetermined time duration but the method is capable of determining the interference value swifter, so that the interference value may be output in real time.

18 Claims, 4 Drawing Sheets

(56) References Cited

U.S. PATENT DOCUMENTS

Figure 1:
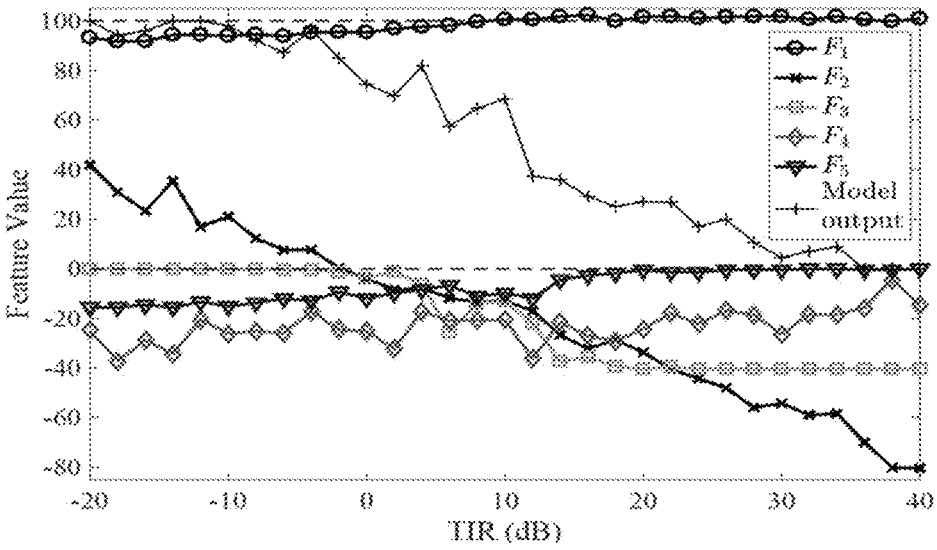

| | | | | |
|---|---|---|---|---|
| 2013/0157729 | A1* | 6/2013 | Tabe | H04W 52/0245 455/573 |
| 2013/0230175 | A1 | 9/2013 | Bech et al. | |
| 2014/0064501 | A1 | 3/2014 | Olsen et al. | |
| 2015/0264507 | A1* | 9/2015 | Francombe | H04S 7/301 381/303 |

OTHER PUBLICATIONS

Betlehem, Terence et al. "Personal Sound Zones." *IEEE Signal Processing Magazine* (2015): 81-91.
Chalupper, Josef and Hugo Fastl. "Dynamic Loudness Model (DLM) for Normal and Hearing-Impaired Listeners." *Acta Acustica United with Acustica* 88 (2002): 378-386.
Chang, Ji-Ho et al. "A realization of sound focused personal audio system using acoustic contrast control." *J. Acoust. Soc. Am.* 125.4 (2009): 2091-2097.
Choi, Joung-Woo and Yang-Hann Kim. "Generation of an acoustically bright zone with an illuminated region using multiple sources." *J. Acoust. Soc. Am.* 111.4 (2002): 1695-1700.
Druyvesteyn, W.F. et al. "Personal Sound." *Proceedings of the Institute of Acoustics*, 16.2 (1004): 571-585.
Emiya, Valentin et al. "Subjective and Objective Quality Assessment of Audio Source Separation." *IEEE Transactions on Audio, Speech, and Language Processing* 19.7 (2011): 2046-2057.
Francombe, Jon et al. "Perceptually optimised loudspeaker selection for the creation of personal sound zones." AES 52$^{nd}$ International Conference, Guildford, UK, Sep. 2-4, 2013.
Francombe, Jon et al. "Modelling listener distraction resulting from audio-on-audio interference." *Proceedings of Meetings on Acoustics* 19 (2013), ICA 2013 Montreal, Montreal, Canada, Jun. 2-7, 2013.
Francombe, Jon et al. "Elicitation of attributes for the evaluation of audio-on-audio interference." *J. Acoust. Soc. Am.* 136.5 (2014): 2630-2641.
Francombe, Jon et al. "A Model of Distraction in an Audio-on-Audio Interference Situation with Music Program Material." *J. Audio Eng. Soc.* 63.1/2 (2015): 63-77.
Glasberg, Brian R. and Brian C.J. Moore. "A Model of Loudness Applicable to Time-Varying Sounds." *J. Audio Eng. Soc.* 50.5 (2002): 331-342.
Jepsen, Morten L. et al. "A computational model of human auditory signal processing and perception." *J. Acoust. Soc. Am.* 124.1 (2008): 422-438.
Karjalainen, Matti et al. "Estimation of Modal Decay Parameters from Noisy Response Measurements." AES 110$^{th}$ Convention, Amsterdam, The Netherlands, May 12-15, 2001.
Moore, B.C.J. and B.R. Glasberg. "A Revision of Zwicker's Loudness Model." *Acustica acta acustica* 82 (1996): 335-345.
Møller, Martin Bo et al. "A Hybrid Method Combining Synthesis of a Sound Field and Control of Acoustic Contrast." AES 132$^{nd}$ Convention, Budapest, Hungary, Apr. 26-29, 2012.
Olik, Marek et al. "A Comparative Performance Study of Sound Zoning Methods in a Reflective Environment." AES 52$^{nd}$ International Conference, Guildford, UK, Sep. 2-4, 2013.
Pasco, Yann et al. "Interior sound field control using generalized singular value decomposition in the frequency domain." *J. Acoust. Soc. Am.* 141.1 (2017): 334-345.
RämöJussi et al. "Validation of a Perceptual Distraction Model in a Complex Personal Sound Zone System." AES 141$^{st}$ Convention, Los Angeles, CA, USA, Sep. 29-Oct. 2, 2016.
Rennies, Jan et al. "Modeling Temporal Effects of Spectral Loudness Summation." *Acta Acustica United with Acustica* 95 (2009): 1112-1122.
Schellekens, Daan H.M. et al. "Time Domain Acoustic Contrast Control Implementation of Sound Zones for Low-Frequency Input Signals." 2016 IEEE International Conference on Acoustics, Speech and Signal Processing (ICASSP), Mar. 20-25, 2016.
Shin, Mincheol et al. "Maximization of acoustic energy difference between two spaces." *J. Acoust. Soc. Am.* 128.1 (2010): 121-131.
Vincent, Emmanuel. "Improved perceptual metrics for the evaluation of audio source separation." 10$^{th}$ International Conference on Latent Variable Analysis and Signal Separation (LVA/ICA), Tel Aviv, Israel, Mar. 2012: 430-437.
Wu, Yan Jennifer and Thushara D. Abhayapala. "Spatial Multizone Soundfield Reproduction: Theory and Design." *IEEE Transactions on Audio, Speech, and Language Processing* 19.6 (2011): 1711-1720.
Zwicker, Eberhard. "Procedure for calculation loudness of temporally variable sounds." *J. Acoust. Soc. Am.* 62.3 (1977): 675-682.
DIN 45631/A1:2010—Calculation of loudness level and loudness from the sound spectrum.
ISO 532-1:2017, Acoustics—Methods for calculating loudness—Part 1: Zwicker Method, ISO 2017.
Zwicker, Eberhard and Hugo Fastl., Psychoacoustics: Facts and models. Springer Verlag, 1990, 3$^{rd}$ Edition available at http://zhenilo.narod.ru/main/students/Zwicker_Fastl.pdf.

* cited by examiner

SYSTEM AND A METHOD FOR DETERMINING AN INTERFERENCE OR DISTRACTION

This application claims priority to Denmark Patent Application No. DK PA 201700219 which has an International filing date of Mar. 29, 2017, the entire contents of which are incorporated herein by reference.

The present invention relates to a system and a method for determining interference between a sound signal and an interfering signal, such as for providing sound in two sound zones in a space.

Distraction, in an interfering audio-on-audio scenario, describes how much one or more interfering audio sources pull your attention or distract you from the target audio you are concentrating on. Personalized sound zones are special applications, where users are experiencing audio-on-audio interference. The original idea of sound zones was proposed by Druyvesteyn et al in 1994. Since then, the concept and methods of sound zones have been further developed.

In an ideal sound-zone system, loudspeakers deliver sound to a bright zone with a desired sound pressure level (SPL) while simultaneously creating a dark zone with zero SPL. Multiple sound-zones within one acoustical space can be created by superpositioning several bright and dark zone pairs. In practice, however, there is leakage of sound from a bright zone into a dark zone, which creates audio-on-audio interference when two or more zones are active.

Perceptual models are often utilized when evaluating a perceived performance of audio systems, especially with complex systems where traditional acoustical measurements do not provide sufficient indication about listeners' perceptual response to the system. The original distraction model, developed by Francombe et. al (see e.g. US2015/0264507, which is hereby incorporated herein in its entirety by reference), aims to predict the perceived distraction users experience in an audio-on-audio interference situation.

A disadvantage of the original distraction model is that it is time consuming to run. It takes approximately 13 minutes to calculate a distraction estimate for a 10-second audio sample. Thus, it is desired to improve the model to be able to operate in real time and make it usable in practical applications.

In a first aspect, the invention relates to a method of determining an interference value, the method comprising:

1. providing a sound signal,
2. providing an interferer signal,
3. establishing a pair of a first portion of the sound signal and a second portion of the interferer signal, the first and second portions having a predetermined time duration,
4. determining a first signal strength of the first portion,
5. determining a second signal strength of the second portion,
6. determining a third signal strength of a combination of the first and second portions, and
7. determining the interference value on the basis of the first, second and third signal strengths, wherein steps 3-7 are performed within a period of time being less than the predetermined time duration.

In this context, an interference value may be a value which represents an interference, such as a presence, of one audio signal to be provided in one sound zone in another sound zone where that audio signal is not desired.

In general, an audio signal (sound signal and/or interferer signal) may be represented in any manner and may represent any type of audio, such as music, speech, noise, silence or the like. An audio signal may be an electrical signal, an optical signal, a digital signal, an analogue signal, an encrypted/convoluted signal or not. A signal may be provided on a physical connection such as a wire, a glass fibre or the like or on a carrier, such as an UHF frequency, on a WiFi connection, on a Bluetooth connection or the like.

An audio signal may be a single file, a packetized signal, a streamed signal or the like.

A sound signal may be that desired in one sound zone, where the interferer signal then may be a signal fed to the other sound zone, where the interference value then may describe or quantify the interferer signal presence in the one sound zone.

The sound signal and/or interferer signal may thus be provided in any manner and on any format. Naturally, if the sound signal or interferer signal is representing silence, it need not be provided from outside of the system or method, as it will have a predetermined value which may simply be fed to the method.

A first portion of the sound signal is established. The first portion has a predetermined time duration. Thus, the portion may be a snip of the sound signal from a first point in time to a second point in time, where the difference between the two points in time is the predetermined time duration. The time duration may be any value, such as 0.5 s, 1 s, 2 s, 3 s, 4 s, 5 s, 6 s, 7 s, 8 s, 9 s, 10 s, 15 s, 20 s, 30 s, 45 s, 60 s, or more, 0.5-60 s, such as 1-45 s, such as 5-30 s, such as 7-15 s The second portion may be established in the same manner of the interferer signal. Usually, the first and second portions have the same or at least substantially the same time duration. Also, preferably, the first and second portions are received and/or output simultaneously. In one embodiment, the sound signal and interferer signal are each output from a microphone or other sound sensor or sensing system (which may comprise a number of microphones, such as a microphone array or a HATS arrangement) positioned e.g. in the sound zones and where the first and second portions then are detected, output or received simultaneously.

The first and second portion may be said to be a pair of portions which may then be used in the determination.

Naturally, a sequence of such portions and/or pairs may be provided, where the portions may overlap or not. Overlapping portions thus are portions of the sound signal or interferer signal where one portion starts at a point in time between the starting and ending points of time of another portion. Portions may be neighbouring, so that one portion starts at the point in time where another portion stops. An overlapping portion may then exist in which a portion of both neighbouring portions is seen.

The portions may be unaltered portions of the sound/interferer signals or may be derived therefrom if desired. In one situation, a portion may be a filtered part of the sound/interferer signal. In one situation, a transfer function is determined which may be applied to the sound signal or the interferer signal or a portion. In one situation, the transfer function may represent surroundings of a sound zone, such as reflections/absorptions thereof, so that an audio signal may be converted from e.g. that desired provided in the sound zone into the audio signal actually detected or heard in the sound zone due to the influence of the surroundings. This transfer function may be determined for one or more sound zones and used in the method if desired.

A first signal strength is determined from the first portion. Naturally, the first signal strength may also or alternatively be determined from the sound signal. The signal strength may be determined in any desired manner, such as a maximum of a signal value in the portion or signal.

It is noted that in this context, a signal strength may be a single value of the signal strength of a portion, such as a maximum value or a mean value. However, the signal strength may vary over time and then describe the signal strength over time of the portion.

In the same manner, a second signal strength is determined of the second portion. Often, the same method is used for determining the signal strengths of the first and second portions. If different methods are used, the method may be altered to take this into account.

in addition, a third signal strength is determined for a combination of the first and second portions. Again, the same method may be used for determining the signal strength.

The combination of the first and second portions may be a simple summing or addition of the portions, such as if they were analogue signals. If the signals are digital, packet based, encrypted, encoded, convolved and/or provided on a carrier frequency, the combination could comprise additional steps.

Then, the interference value is determined on the basis of the signal strengths. Often, one or more values or parameters are determined from one or more of the signal strengths, which value(s) or parameter(s) is/are then used in a determination of the interference value.

In one embodiment, the interference value is determined from a generic formula as:

$$y=c+\Sigma(i*j)$$

where i is a constant and j is a value or parameter determined as described, and where the summation is over the individual parameters. In the preferred embodiment, 5 different values/parameters are determined from the portions. Then, the constant c and the constants i may be determined, such as empirically or from listening tests, so that y, which is the interference value, may be determined.

According to this aspect of the invention, steps 3-7 are performed within a period of time being less than the predetermined time duration. In this manner, the interference value may be determined in real time. When sequential portions are determined, sequential interference values may be determined which may be output with the same rate as the time duration of the portions. Naturally, portions may be overlapping, if the determination is swift enough. Thus, sequential 10 s portions may be used as well as another sequence of 10 s portions but staggered 5 s from the first sequence, so that interference values are output every 5 s but for 10 s portions.

It is noted that the interference may be that seen in one sound zone from another sound zone. This may be reciprocated, so that another interference value may be determined as that seen in the other sound zone from the one sound zone. In this situation, steps 3-7 or 4-7 may be repeated. Preferably, these steps may, in addition to the "initial" steps 3-7, be performed within a period of time being less than the predetermined time duration.

Naturally, it would be possible to have multiple pairs of sound zones and thus audio/interferer signals and thus interference values.

In one embodiment, step 7 comprises determining the interference value based on a value determined from the third signal strength. The third signal strength relates to the signal strength of the combined portions. In one embodiment, a value used in the determination of the interference value may be a maximum value of the third signal strength.

In that or another embodiment, step 7 comprises determining the interference value based on a value determined from a first value determined from the first and second signal strengths. In one manner, the first value may be based on a mean value of the first and second signal strengths. In another manner, the value may be determined from a thresholding of a sum of the two signal strengths. Actually, and especially in the latter situation, the value may be determined based on only some of the portions, if desired. This will lift the computational burden of the calculations.

Then, preferably, step 7 comprises determining the interference value based on an additional value determined from the first value. It has been found that in some situations, the values usually used in the determination of interference values, actually are so similar, that one value may be determined from another value. As will be described below, one value, which is determined on the basis of a ratio of the first and second signal strengths, may, over the different ratios, rather closely follow the first value. Thus, the additional value may be substituted for the first value at least within the ratio interval in question.

In one embodiment, step 7 comprises determining a ratio of the first and second signal strengths and determining the interference value based on a parameter determined on the basis of the ratio, the parameter being at least substantially constant, when the ratio is below a lower threshold and at least substantially constant when the ratio is above a second threshold being larger than the first threshold.

In this situation, an at least substantially constant value may be a value which deviates no more, in the interval in question, such as below the lower threshold or above the upper threshold, than 10%, such as no more than 5%, such as no more than 1%, of a maximum value of the value in this interval.

Then, the parameter, when the ratio is between the first and second thresholds, could be determined from the first and second signal strengths, such as from the above first value. Alternatively, the parameter may be determined in a more historic manner, such as using the so-called PEASS method.

In a preferred embodiment, step 4, 5 and/or 6 comprises determining the signal strength as a loudness of the portion. Alternatively to the loudness, any other quantification of e.g. sound pressure may be used.

In one embodiment, the loudness is determined using the ITU loudness algorithm, which is hereby incorporated by reference. The ITU loudness algorithm is a standard routine developed for streaming and is thus aimed at real-time determination of the loudness.

It is noted that an aspect of the invention is the determination of the loudness, such as using the ITU method, in steps 4-6, without the speed or timing requirement. This method may be combined with any of the other aspects and embodiments of the invention.

A second aspect of the invention relates to a method of providing sound in each of two sound zones, the sound signal representing sound desired in a first of the sound zones and the interferer signal representing sound desired in a second of the sound zones, the method comprising determining an interference value according to the first aspect of the invention as well as the following step of:

8. determining a signal for each of a plurality of sound emitters positioned in the vicinity of the first and second sound zones, each signal being based on the sound signal, the interferer signal and the interference value.

Usually, the sound emitters are provided in a vicinity of the sound zones. A sound zone need not be indicated or the like. A sound zone is an area or volume in a space where the method may be optimized for outputting the sound desired.

Any number of speakers may be used. Even though it is desired to use as few speakers as possible, a good separation of the sound zones may require a large number of speakers, such as 10 speakers or more, such as 20 speakers or more, such as 30 speakers or more, such as 40 speakers or more, such as 50 speakers or more, such as 60 speakers or more.

Usually, two sound zones are defined and controlled in relation to each other. However, any number of sound zones or pairs of sound zones may be defined.

Usually, the sound desired in a sound zone is selected or determined as a sound track or other sound signal. In addition to this signal, the signals for the speakers usually will be filtered and/or delayed in order to arrive at the desired interference of the sound from the speakers in the sound zones to arrive at the desired result. This filtering and delay may be different from speaker to speaker and may be determined empirically or based on a calibration in which the relative positions of the sound zones and the speakers may be taken into account. Also, the positions and characteristics of reflecting/absorbing surfaces/elements (ceiling, floor, wall, furniture, drapes or the like) may be taken into account in this calibration.

Thus, the providing of the signals for the speakers may be based on also other features than the interference value.

The interference value may, however, cause other adaptations of the signals for the speakers, such as the turning up or down of the volume of one or both of the sound signal and the interferer signal—or a filtering of one or both of the signals. Further below, it is described how multiple interference values may be determined for e.g. auto-correcting one or both signals, or in order to propose a change in a signal.

Naturally, the method may further comprise the step of actually feeding the determined signals to the sound emitters in order to generate the desired sound in the sound zones.

Preferably, steps 3-8 are performed within a period of time being less than the predetermined time duration. This is again in order to obtain a real-time operation.

A third aspect of the invention relates to a system for determining an interference value, the system comprising:

1. a first input configured to receive a sound signal,
2. a second input configured to receive an interferer signal,
3. a first processor configured to establish a pair of a first portion of the sound signal and a second portion of the interferer signal, the first and second portions having a predetermined time duration,
4. a second processor configured to determine a first signal strength of the first portion,
5. a third processor configured to determine a second signal strength of the second portion,
6. a fourth processor configured to determine a third signal strength of a combination of the first and second portions, and
7. a fifth processor configured to determine the interference value on the basis of the first, second and third signal strengths, wherein steps 3-7 are performed within a period of time being less than the predetermined time duration.

Naturally, all considerations, embodiments, alternatives and the like mentioned above are equally valid in the present aspect of the invention.

An input may be any type of input configured to receive a signal. As mentioned above, the signal(s) may be on any format, such as electrical, optical, wireless, radio transmitted, WiFi, Bluetooth, analogue, digital, packet based, a single file, a streamed signal, or the like.

Thus, an input may comprise an antenna or other detector for receiving a wireless signal, as well as any decoder, converter, deconvoluter, frequency converter or the like for generating a signal suitable for use in the processor(s).

Naturally, the first and second inputs may be a single such element, if, for example, both signals are wireless or transported on the same wire(s).

A particular situation exists when one of the sound signal and the interferer signal represents silence. In this situation, no signal needs be received but may, in the model and/or in the processor(s) be represented by a constant value, such as zero.

A processor may be a single chip, ASIC, DSP, server or the like. Alternatively, multiple, such as 2, 3, 4 or all processors may be formed by one or more processors, ASICs, DSPs or servers, or combinations thereof. The processors or the like may be remote and/or remote and may be in communication with each other.

The first processor establishes a pair as described above. This may be a simple gating of a signal so as to derive a portion of the signal received, processed or output between a first and a second point in time.

As described above, the portions preferably are portions of the respective signals received, processed or output simultaneously.

Determination of a signal strength may be performed in a number of manners, such as determining a mean value of the signal strength, a maximum value thereof or any other value derived from the portion. A preferred measure or quantification of the signal strength is the loudness.

It is noted that loudness as such is a subjective measure, describing how loudly or softly a sound is perceived by humans. Here, we prefer measured loudness, which is an estimation of subjective loudness and may be calculated from the signal strength that can be, but is not limited to sound pressure, sound pressure level, intensity, root mean squared value, sound energy or power. This also includes frequency weighted versions of these, such as A, B, C, D, or K weighting, which are often used to account for the sensitivity of the human hearing system.

Known algorithms to estimate loudness include standards like the ITU-R BS.1770, DIN 45631/A1:2010, ISO 532-1: 2017, and ANSI/ASA S3 (both incorporated herein in their entireties by reference). Furthermore, there are plenty of loudness algorithms published by the audio research community, e.g., the Zwicker method:

[1] Zwicker, E.: Procedure for calculating the loudness of temporally variable sounds. J. Acoust. Soc. Am. 62, 675-682(1977).

[2] Zwicker, E., Fastl, H.: Psychoacoustics, Facts and Models, Springer Verlag, Berlin, Germany, 1990.

[3] Moore, B. C. J., Glasberg, B. R.: A Revision of Zwicker's Loudness Model, Acta Acoustica Vol. 82, 1996.

the dynamic loudness model:

[4] Chalupper, J. and Fastl, H., Dynamic loudness model (DLM) for normal and hearing-impaired listeners, Acta Acoustica united with Acoustica 88, 378-386. 2002

[5] Rennies, J., Verhey, J., Chalupper, J., and Fastl, H., Modeling Temporal Effects of Spectral Loudness Summation, Acta Acoustica united with Acoustica 95, 1112-1122. 2009.

and the Glasberg-Moore model for time-varying signals:

[6] B. R. Glasberg and B. C. J. Moore, A model of loudness applicable to time-varying sounds, J. Audio Eng. Soc., vol. 50, no. 5, pp. 331-342, May 2002.

All the above references are hereby incorporated herein in their entireties by reference.

The signal strength of the first portion, the second portion and the combination thereof is determined. The combination may be obtained as described above and may be generated by the fourth processor or the first processor or a separate processor.

The interference value may be determined in a number of manners. A wide variety of interference values and methods have been described. Usually, the interference value is determined by the method described above, where a number of values/parameters are determined from the signal strengths and/or the portions or signals, and are then each multiplied with a constant—and then finally summed.

According to this aspect of the invention, steps 3-7 are performed within a period of time being less than the predetermined time duration. Thus, the interference value may be determined within a period of time in which the portions of the signals may be output to e.g. sound zones. Thus, the interference value determination is in real-time.

Another aspect of the invention relates to a system for providing sound in each of two sound zones, the sound signal representing sound desired in a first of the sound zones and the interferer signal representing sound desired in a second of the sound zones, the system comprising a system for determining an interference value according to the third aspect, and a sixth processor configured to determine a signal for each of a plurality of sound emitters positioned in the vicinity of the first and second sound zones, each signal being based on the sound signal, the interferer signal and the interference value.

Thus, all embodiments, considerations and the like of the above aspects are equally valid in relation to this aspect of the invention.

Naturally, the sixth processor may be a separate processor or may be a part of one of the other processors. Processors are usually able to handle simultaneous or parallel processing, and some of the tasks to be carried out are to be performed after other tasks, so that serial processing may also be possible.

Naturally, the system may also comprise the sound emitters. Usually, the sound emitters are positioned in a space in which one or more, typically two, sound zones are determined. Then, the interference value may be a quantification of the interference, in one sound zone, of sound desired in the other sound zone. Often, the sound emitters, or at least some of the sound emitters, are positioned around a space comprising the sound zones.

Often, the system comprises an adaptation element configured to adapt an audio signal before transmission to a sound emitter. This adaptation may be amplification, filtering and/or delaying of the signal. This element, or a portion of it, may be provided in the pertaining sound emitter. Often this element or the function thereof is programmable and may be altered. Often, the operation of these elements will depend on the space in which the sound zones are positioned, such as the relative position of the sound zones and reflecting or absorbing elements, such as furniture, walls and the like.

Naturally, the system may further comprise a signal source configured to feed the audio signal to the first input. This signal source may be an antenna, a computer, a storage or the like. The audio signal may be read as a single file from a storage or streamed from a remote server or streaming service or from a local server if desired.

In addition, the sound signal and/or the interferer signal may be generated by or received from microphones positioned in desired areas such as within sound zones. A microphone, or a series of microphones, may be provided in each sound zone to output the signal then used as the sound signal and the interferer signal in the method and system. Alternatively, microphones may be positioned in the sound emitters. The outputs of the microphones may be converted into a signal output by a "virtual" microphone positioned in a sound zone, so that no physical microphone is required in the actual sound zone.

Using one or more microphones, any interference or influence from reflecting/absorbing surfaces or elements as well as changes in the relative positions of such elements and the sound zones will automatically be taken into account in the determination of the interference value.

Naturally, the interference value may be used in a number of manners. One manner would be to characterize a space or sound zones in order to quantify the quality of the sound separation. Alternatively, the interference value may be used for correcting the signals fed to or to be fed to the sound emitters, such as to turn the sound in one sound zone up or the sound in the other sound zone down. Also, filtering may be performed, if it affects the interference value.

Also, if the interference value is determined much swifter than the predetermined period of time, the sound/interferer signal(s) may be amended and the interference value recalculated so that changes to the signal(s) may be proposed or actually made if such changes affect the interference value in a positive direction.

Figure 2:
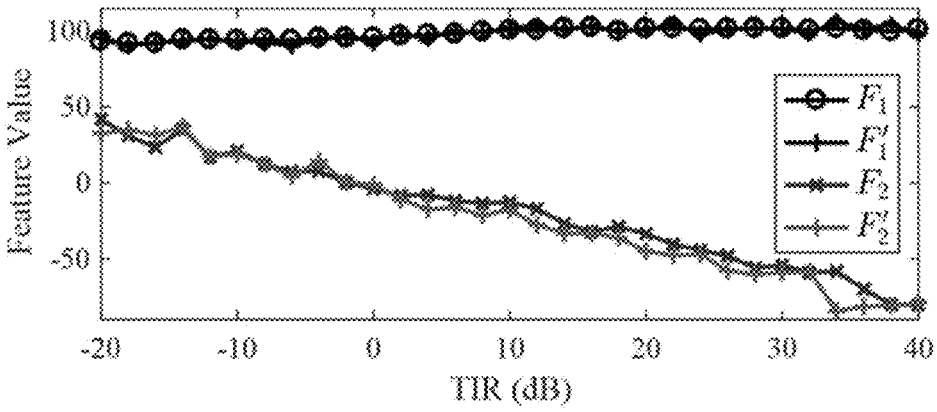
Figure 3:
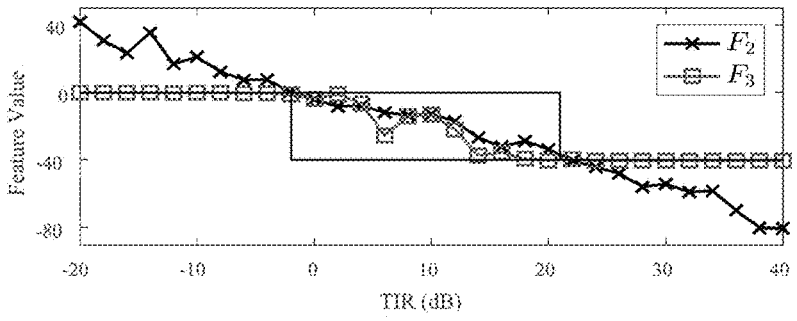

In the following, preferred embodiments will be described with reference to the drawings, wherein:

FIG. 1 illustrates model features calculated with the distraction model using Eq. (1), FIG. 2 illustrates a comparison of the original features F1 and F2 against the proposed F1' and F2', FIG. 3 illustrates features 2 and 3 plotted together (same curves as in FIG. 1)

Figure 4:
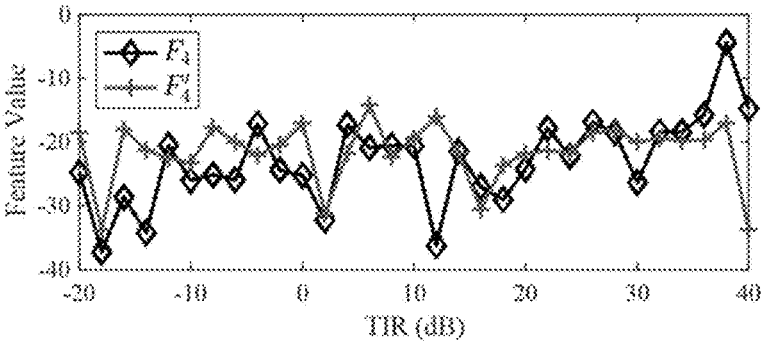
Figure 5:
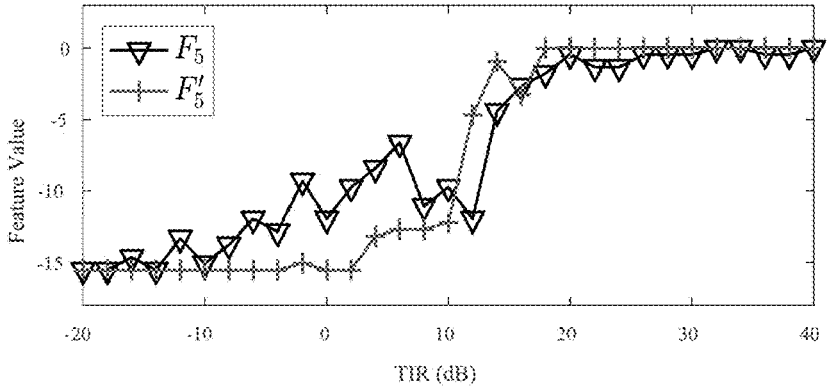
Figure 6:
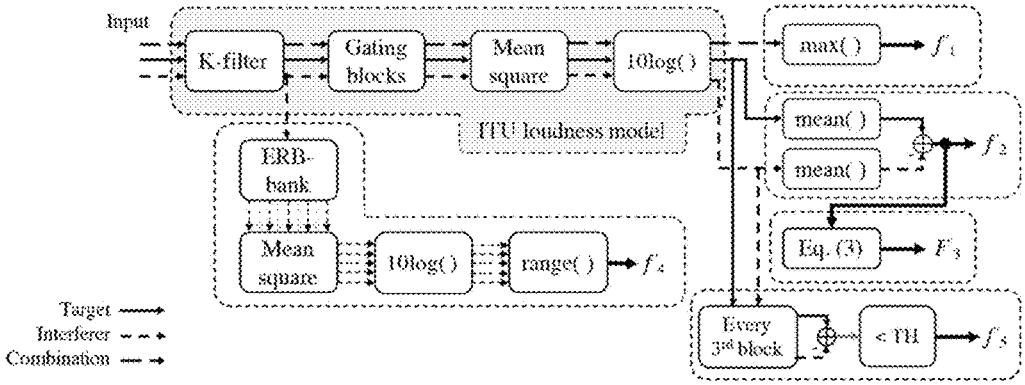
Figure 7:
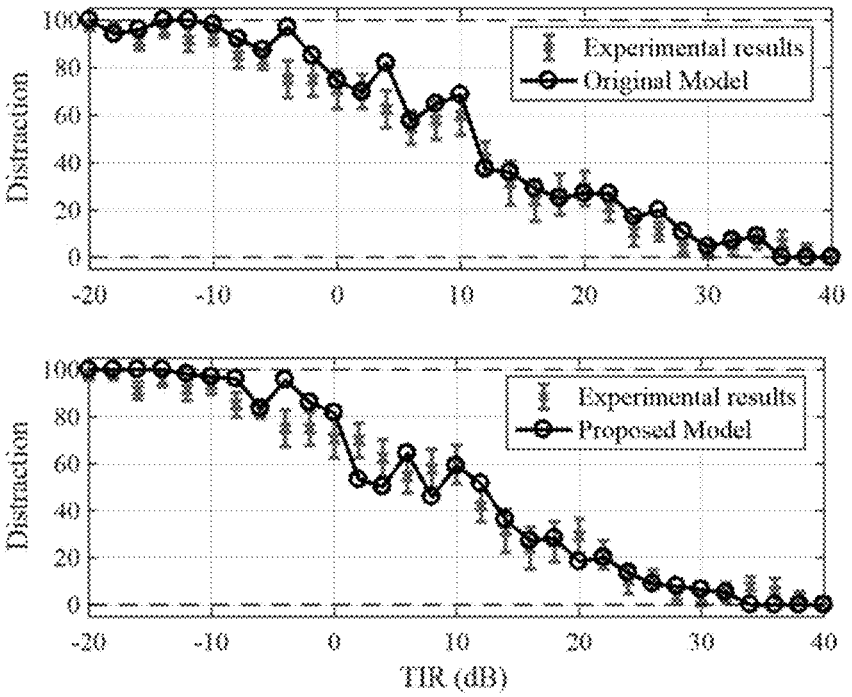
Figure 8:
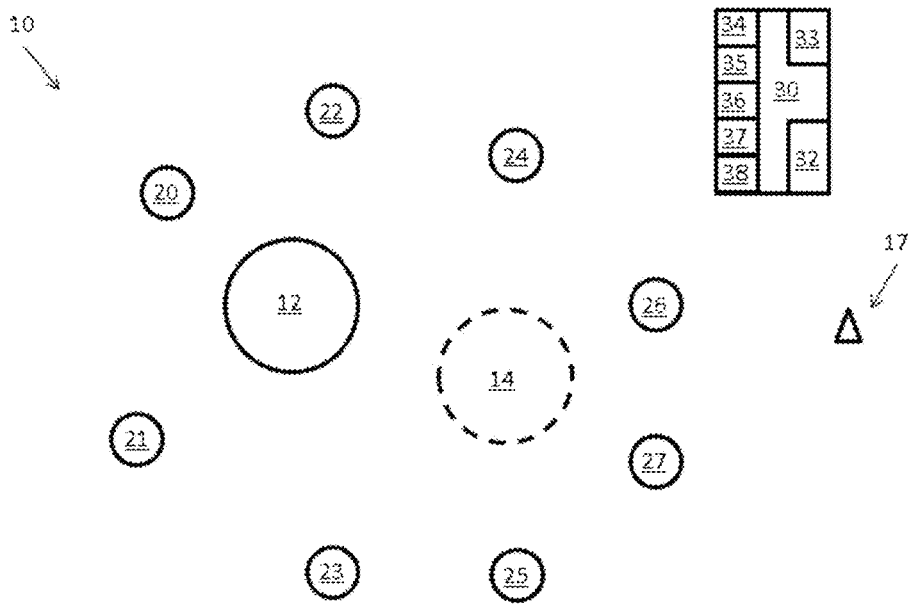

FIG. 4 illustrates a comparison of the original feature 4 and the novel feature 4, FIG. 5 illustrates original feature 5 with the new feature 5, FIG. 6 is a Block diagram of the proposed ITU-based distraction model, FIG. 7 illustrates experimental results from a listening test (x) and the predictions of the original and proposed distraction model (o), top and bottom subfigures, respectively, and FIG. 8 illustrates the main blocks of a system embodying the invention and having the sound zones.

In the following, a real-time perceptual model is described predicting the experienced distraction occurring in interfering audio-on-audio situations. The inventive model improves the computational efficiency of a previous distraction model. The preferred approach is to utilize similar features as the previous model, but to use faster underlying algorithms to calculate these features. Naturally, alternative methods may be used instead of these similar features. The results show that the proposed model has a root mean squared error of 11.9%, compared to the previous model's 11.0%, while only taking 0.4% of the computational time of the previous model. Thus, while providing similar accuracy as the previous model, the proposed model can be run in real time. The proposed distraction model can be used as a tool for evaluating and optimizing sound zone systems. Furthermore, the real-time capability of the model introduces new possibilities, such as adaptive sound-zone systems.

The original model utilizes three different algorithms/toolboxes, namely Glasberg-Moore loudness algorithm for time-varying sounds, PEASS software toolbox for Matlab, and Computational Auditory Signal processing and Perception (CASP) model. The features and algorithms are summarized in Table I, where the input column illustrates the recording technique of the input samples, i.e., either a head-and-torso simulator (HATS) or a single channel measurement microphone (Mic) recording. The output column shows which features that are calculated with which algorithms, and the time column shows the approximate computational time for each algorithm (using Matlab and a Mid 2014 MacBook Pro), when the length of the used portion of the input signal is 10 seconds. All three algorithms take the target and interferer signals as inputs and combine the two signals in case a combined signal (target+interferer) is needed.

The historic model calculates five features, and has one constant term. The features are defined as follows:

- f1: Maximum long-term loudness (LTL) of the target and interferer combination,
- f2: Target-to-interferer ratio (TIR) using LTL,
- f3: Interference-related Perceptual Score (IPS) calculated with the PEASS software toolbox,
- f4: The range of CASP model output for the interferer signal at high frequencies (bands 20-31), and
- f5: Percentage of temporal windows (400 ms, 25% overlap) where CASP model's TIR<5 dB.

The model output, $\hat{y}$, is limited between 0 (not at all distracting) and 100 (overpoweringly distracting) and is calculated as a linear combination of the above features by $$\hat{y} = 24.19 + \frac{1.04f_1}{F_1} - \frac{2.04f_2}{F_2} - \frac{0.41f_3}{F_3} - \frac{0.95f_4}{F_4} - \frac{0.16f_5}{F_5}. \quad (1)$$

FIG. 1 shows the model output $\hat{y}$ (thin line with '+' markers) and the individual features scaled according to Eq. (1). By looking at the scaled features, it is more intuitive to see how each feature contributes to the final distraction estimation, compared to the raw, unscaled features. For example, it is easy to see that there is a high correlation between F2 and the model output $\hat{y}$.

To arrive at FIG. 1, the input signals for the model were recorded in an actual complex personal sound-zone system, where the target signal was music and interfering signal was speech. Different TIR values correspond to different target-interferer sample pairs (see detailed description in [J. Rämö, S. Marsh, S. Bech, R. Mason, and S. H. Jensen, "Validation of a perceptual distraction model in a complex personal sound zone system," in Proc. AES 141st Convention, Los Angeles, Calif., Sep. 2016.], Sec 4.1). All the samples were 10 seconds in duration.

The below preferred model has thus been devised in order to arrive at a faster processing and determination of the model output.

The approach chosen to improve the speed of the distraction model was to utilize the original model and its features, which are determined to operate well in a sound-zone system, but to substitute the underlying algorithms with faster ones.

The first step is to look into the Glasberg-Moore loudness model, and features 1 and 2, since that is the most time-consuming part of the model (see Table I). An alternate, computationally lighter loudness estimation algorithm is specified in ITU-R BS.1770-4 recommendation [see "Algorithms to measure audio programme loudness and true-peak audio level," Recommendation ITU-R BS.1770-4, October. 2015.], which was chosen to be the starting point for the proposed model.

The multichannel ITU loudness algorithm consists of a two-part frequency-weighting filter K, a mean square calculation, a channel-weighted summation, and a gating function. Is noted that the below description mentions only the parts of the algorithm that are used by the proposed model.

K-filtering consists of two cascaded bi-quad filters. The first filter is used to account for the acoustics of the head, whereas the second filter reduces the effect of low frequencies similar to A-weighting. The first filter is not used in the proposed model, since the input signals are recorded with a HATS, which physically takes the acoustics of the head into account.

The gating block intervals in the ITU loudness algorithm are defined to have a duration of 400 ms with 75% overlap. The loudness of $j^{th}$ gating block is $$l_j = -0.691 + 10\log(z_j), \quad (2)$$

where $z_j$ is the mean square of the $j^{th}$ gating block.

As mentioned, the goal of the preferred embodiment of the invention is to use similar features as before, but to estimate the loudness using a different, faster algorithm. Feature 1 is the maximum LTL within a zone, when both target and interfering sources are active, and Feature 2 is the TIR between the zones, also calculated using the LTL. The new proposed features are calculated using the ITU loudness algorithm where • $f'_1$ is the maximum value of $l_j$ (where j=1, 2, . . . ) from the combined signal, and • $f'_2$ is the difference between the mean of the target $l_j$ and the mean of the interferer $l_j$ (where j=1, 2, . . . ).

FIG. 2 illustrates the new features $F'_1$ and $F'_2$, compared to the original ones $F_1$ and $F_2$. As can be seen, the match between the original and new features is reasonably good, which indicates that the ITU loudness algorithm can be used instead of the previously used Glasberg-Moore algorithm.

The historic feature $F_3$ was calculated using the PEASS toolbox, which is typically used when evaluating the quality of sound source separation results. In the original model, this toolbox is used to calculate the Interference-related Perceptual Score (IPS).

When observing FIG. 1, it can be seen that $F_3$ is constant below TIR≈0 dB and above TIR≈20 dB.

Furthermore, when TIR is between 0 dB and 20 dB, $F_3$ follows $F_2$ quite closely. FIG. 3 highlights this by plotting only features 2 and 3. Based on these observations, $F_3$ is substituted with two constants and $F'_2$ as follows $$F'_3 = \begin{cases} 0, & \text{when } f'_2 < 0 \\ F'_2, & \text{when } 0 \le f'_2 \le 20 \\ -40, & \text{when } f'_2 > 20 \end{cases} \quad (3)$$

where $f'_2$ is the TIR calculated with the ITU loudness algorithm. Naturally, any loudness determination may be used.

In the original distraction model, features 4 and 5 are determined based on the CASP model. Even the less computationally heavy CASP algorithm prevents the real time calculation of the model. It thus is preferred to instead use similar features based on the ITU loudness model that is already used when computing $F'_1$ and $F'_2$.

The original feature 4 is described as the range of the CASP model output at high frequencies for the interferer signal. Basically, $F_4$ is determined by calculating the mean of the CASP model output for each frequency band from 20 to 31 for the whole 10s signal portion, and then taking the difference between the maximum and the minimum value of those means.

In order to calculate a similar feature without using the CASP model, the K-filtered interferer signal is divided into frequency bands corresponding to the CASP model bands from 20 to 31. This is done with a simple ERB-motivated filter bank implemented using second-order Butterworth filters. After which, the ITU-based loudness is calculated for each frequency band, and finally the range is evaluated. FIG. 4 illustrates the comparison of the original $F_4$ and $F'_4$ calculated by the preferred, much faster method.

Feature 5 estimates the percentage of temporal windows (400ms, with 25% overlap) where TIR is below 5dB. In the old model, the TIR is calculated from the CASP model outputs of the target and interferer signals. The preferred approach is once more using the ITU-based loudness estimation to calculate the TIRs needed to estimate this feature.

The gating blocks of the ITU loudness model are 400ms long with 75% overlap, thus, when we choose every third block from the ITU algorithm, we obtain 400ms blocks with 25% overlap. The TIR is calculated similarly as in the original model, after which the percentage of windows below a threshold is calculated. The threshold is changed from 5dB to 13dB to get a better match with the original feature. FIG. 5 shows the match between the original and proposed feature.

FIG. 6 is a block diagram of the preferred model as a whole. It is noted that this preferred model is heavily based on the ITU loudness algorithm (grey box). To recapitulate the ITU-loudness algorithm, the input signals are filtered with the K-filter, after which, the signals are windowed into 'Gating blocks'. Then, each block is mean squared and converted into a loudness value with the 10log( ) function, described in Eq. (2).

The loudness values of the gating blocks are used for all features except $f_4$, which requires a filterbank to divide the signal into frequency bands before the loudness estimation. This is done with a filter bank consisting of second-order Butterworth filters using ERB-based center frequencies and bandwidths similar to the CASP model.

The remaining features are calculated as follows (see FIG. 6):

$f'_1$ is the maximum value of the loudness blocks of the combined signal (maximum overall loudness), $f'_2$ is the difference between the mean of the target's and the interferer's loudness blocks (TIR), $F'_3$ is calculated from $f'_2$ using Eq. (3), and $f'_5$ estimates the percentage of windows where the TIR is lower than a certain threshold (TH).

The proposed distraction estimate $y^{\wedge 0}$ is calculated using the same coefficients, except for feature 3 where $F'_3$ is directly obtained based on $f'_2$ and $F'_2$. The distraction estimate is calculated as follows:

$$\hat{y}' = 24.19 + \frac{1.04 f'_1}{F'_1} \frac{-2.04 f'_2}{F'_2} + F'_3 \frac{-0.95 f'_4}{F'_4} \frac{-0.16 f'_5}{F'_5}. \quad (4)$$

FIG. 7 illustrates the predicted distraction values compared to the results of a listening experiment, where people were asked to evaluate the distraction of the same sample pairs that were run through the model. The top subfigure shows the predictions of the original model, and the bottom subfigure plots the predictions of the proposed model. The experimental data are identical in both figures and the vertical error bars in the data show the 95% confidence intervals. As can be seen, the match of the proposed model's predictions to the data is good and the fit is comparable to that of the original model.

Table II shows the results of the preferred model, in the form of various statistic metrics, compared to the original model with two different data sets. Namely, a training data set that was used to train the original model and the validation data set, described above.

The computational time of the proposed model is improved considerably. The original model took approximately 12.7 minutes to calculate a distraction estimate for a 10-second target-interferer sample pair. Now, with the preferred model, it only takes approximately 0.3 seconds, and thus, it can be run in real-time, which is crucial to many practical applications, including sound-zone optimization. (In other words, the proposed model can do around 2500 distraction predictions while the original model calculates only one.)

An additional benefit of the proposed model is that it may be operated using only HATS recordings as input, excluding the need of an extra mono recording which is needed to run the original model.

In fact, in the above model, all the input signals may be HATS recordings. However, it is equally useful to use simple single-microphone recordings or signals.

In FIG. 8, a system is illustrated having a space 10 in which two sound zones 12 and 14 are defined and around which a number of speakers 20-27 are provided. The skilled person knows how to feed, from two sound signals, the speakers so as to obtain different sound in the two sound zones.

Naturally, the audio desired in e.g. the zone 14 may be silence. In that situation, no signal need be input to represent silence.

The sound signal and interferer signal is received and a portion thereof is derived to form a pair of sound snips of a particular length, such as the above 10 s. The signals may be received from a signal emitter, such an antenna for wireless streaming from any source, such as an internet radio, streaming service or the like. One source may be a local storage, such as a hard drive, server, DVD or the like.

A controller 30 comprises an input 32 for receiving the audio signal and/or the interferer signal, processors 34-38 for determining the signal strengths and the interference value as well as any other parameters, and an output 33 for feeding signals to the individual speakers.

Naturally, the processors 34-38 may be made of any number of separate processors, local and/or remote, distributed or as a single processor. Any processor or group of processors may be a single chip, ASIC, DSP or the like.

Alternatively, a source may be a microphone 17 provided in the space 10. Then, the position of the microphone may determine the position of the pertaining sound zone in the space.

An advantage of using a microphone in the sound zone is that surroundings of the sound zone, such as reflecting/absorbing surfaces or elements, such as walls, ceilings, furniture, drapes, carpets and the like, may automatically be taken into account in the sound signal used in the determination of the interference value.

Alternatively, microphones may be provided in one or more of the speakers. Then, signal processing may be performed to arrive at a sound signal received by a "virtual" microphone positioned in the sound zone. In this situation, there is no need for a physical microphone in the sound zone.

If a microphone is not used, a transfer function for a sound zone may be derived so that the influence of absorbing/reflecting surfaces and elements may be taken into account. Thus, from the audio signal to be fed to the speakers, the transfer function may be used to arrive at a representation of the sound which would actually be sensed or heard in the sound zone. In this calculation, the relative positions of the speakers, the sound zones and any reflecting/absorbing elements may be used as well as the direction and/or output characteristics of the speakers and the like.

Usually, when generating sound for sound zones, the original sound signal (e.g. a song) is fed to the speakers but is altered for each speaker. The same is the situation for the signal for the other sound zone. Thus, the signals are amplified/delayed/filtered in order to arrive at the desired sound in the sound zones. This amplification/delay/filtering may be handled centrally or locally using circuits present in each speaker.

The interference value describes the interference, in one sound zone, of sound from the other sound zone. This information may be used in a number of manners.

In one situation, the interference value may be used for correcting or adapting the sound signal and/or the interferer signal, such as to turn a volume or signal strength of one signal up/down in relation to the other. Thus, if the interference in zone 12 from zone 14 is too large, the sound in zone 12 may be turned up or the sound in zone 14 may be turned down.

In addition or alternatively, one of or both of the sound signal and the interferer signal may be filtered to reduce the interference.

In fact, as the present method of obtaining the interference value is so much faster than what is required to operate in real time, multiple interference values may be determined for different pairs of sound signal and interferer signal.

For example, the interference value may be compared to a threshold value. If it is satisfactory, i.e. that the interference is at an acceptable, low value, nothing need be done. If the interference, though, is at a higher level, it may be investigated whether particular adaptations of one or both of the audio signal and interferer signal will improve the interference.

Then, a predetermined alteration may be performed of the audio signal and/or the interferer signal, where after a new interference value is determined based on also this/these altered signal(s). One alteration may be to turn the volume of a signal up. Another alteration may be to turn the volume of a signal down. Another alteration may be to filter a signal. Naturally, combinations may be performed.

Then, if an adaptation is identified which reduces the interference value, such as reduces it to below a threshold value, the pertaining adaptation may be performed or may be proposed to a user of the system.

TABLE I

THE ORIGINAL DISTRACTION MODEL. ESTIMATED COMPUTATIONAL TIMES ARE FOR 10-SECOND SAMPLES.

| Algorithm | Input | Output | Time |
|---|---|---|---|
| Glasberg-Moore [16] | HATS | $f_1$, $f_2$ | ~10 min. |
| PEASS [17], [18] | Mic | $f_3$ | ~2 min. |
| CASP [19] | HATS | $f_4$, $f_5$ | ~40 sec. |

TABLE II

PERFORMANCE OF THE PROPOSED MODEL COMPARED AGAINST THE ORIGINAL MODEL [20].

| | Original Model | | Proposed Model |
|---|---|---|---|
| Statistics | Training [14] | Validation [20] | Validation [20] |
| RMSE (%) | 9.46 | 11.0 | 11.9 |
| RMSE* (%) | 4.41 | 5.56 | 5.24 |
| R | 0.94 | 0.99 | 0.98 |
| $R^2$ | 0.88 | 0.96 | 0.95 |
| Adjusted $R^2$ | 0.87 | 0.94 | 0.93 |

The invention claimed is:

1. A method of determining an interference value, the method comprising:

providing a sound signal;

providing an interferer signal;

establishing a pair of a first portion of the sound signal and a second portion of the interferer signal, the first and second portions having a particular time duration;

determining a single value of a first sound energy of the first portion;

determining a single value of a second sound energy of the second portion;

determining a single value of a third sound energy of a combination of the first and second portions; and determining the interference value based on one single value of the single values of the first, second and third sound energies, wherein the establishing, the determining the first sound energy, the determining the second sound energy, the determining the third sound energy, and the determining the interference value are performed within a period of time that is less than the particular time duration.

2. A method according to claim 1, wherein the interference value is determined based on the single value of the third sound energy.

3. A method according to claim 1, wherein the interference value is determined based on a value determined from a first value determined from the single values of the first and second sound energies.

4. A method according to claim 3, wherein the interference value is determined based on an additional value determined from the first value.

5. A method according to claim 3, wherein the determining the interference value includes determining a ratio of the single values of the first and second sound energies, and determining the interference value based on a parameter determined based on the ratio, the parameter being at least substantially constant based on the ratio being below a first threshold and at least substantially constant based on the ratio being above a second threshold that is larger than the first threshold.

6. A method according to claim 5, wherein the parameter is determined based on the first and second sound energies, based on the ratio being between the first and second thresholds.

7. A method according to claim 1, wherein the single value of the first sound energy is a loudness of the first portion, the single value of the second sound energy is a loudness of the second portion, and/or the single value of the third sound energy is a loudness of the combination of the first and second portions.

8. A method according to claim 7, wherein each loudness is determined using an ITU loudness algorithm.

9. A method according to claim 1, wherein the method includes providing sound in each sound zone of two sound zones, the sound signal represents sound desired in a first sound zone of the two sound zones, the interferer signal represents sound desired in a second sound zone of the two sound zones, and the method further includes determining a signal for each sound emitter of a plurality of sound emitters positioned in a vicinity of the first and second sound zones, each signal being based on the sound signal, the interferer signal and the interference value.

10. A method according to claim 9, wherein the establishing, the determining the first sound energy, the determining the second sound energy, the determining the third sound energy, and the determining the interference value, and the determining the signal for each sound emitter of a plurality of sound emitters positioned in a vicinity of the first and second sound zones are performed within the period of time that is less than the particular time duration.

11. A method according to claim 9, further comprising:

providing the determined signal for each sound emitter of the plurality of sound emitters positioned in the vicinity of the first and second sound zones to the plurality of sound emitters.

12. A system for determining an interference value, the system comprising:

a first input configured to receive a sound signal;

a second input configured to receive an interferer signal;

a first processor configured to establish a pair of a first portion of the sound signal and a second portion of the interferer signal, the first and second portions having a particular time duration;

a second processor configured to determine a single value of a first sound energy of the first portion;

a third processor configured to determine a single value of a second sound energy of the second portion;

a fourth processor configured to determine a single value of a third sound energy of a combination of the first and second portions; and a fifth processor configured to determine the interference value based on the single values of the first, second and third sound energies, wherein the establishing, the determining the first sound energy, the determining the second sound energy, the determining the third sound energy, and the determining the interference value are performed within a period of time that is less than the particular time duration.

13. A system according to claim 12, wherein the system is configured to provide sound in each sound zone of two sound zones, the sound signal represents sound desired in a first sound zone of the two sound zones, the interferer signal represents sound desired in a second sound zone of the two sound zones, the system further includes a sixth processor configured to determine a signal for each sound emitter of a plurality of sound emitters positioned in a vicinity of the first and second sound zones, each signal being based on the sound signal, the interferer signal and the interference value.

14. A system according to claim 13, further comprising: the plurality of sound emitters.

15. A system according to claim 13, further comprising:

a signal source configured to feed an audio signal to the first input.

16. A method according to claim 1, wherein the determining the first sound energy includes determining the single value of the first sound energy from a pre-processed version of the first portion.

17. A method according to claim 16, wherein the pre-processed version of the first portion is a filtered version of the first portion.

18. A method according to claim 17, wherein the filtered version of the first portion is a K-filtered version of the first portion.

* * * * *